US005243189A

United States Patent [19]

Nagai et al.

[11] Patent Number: 5,243,189

[45] Date of Patent: Sep. 7, 1993

[54] ION NEUTRALIZER

[75] Inventors: Kazutoshi Nagai, Tokyo; Tohru Satake; Hideaki Hayashi, both of Kanagawa; Yoshio Hatada, Tokyo, all of Japan

[73] Assignee: Ebara Corporation, Tokyo, Japan

[21] Appl. No.: 871,984

[22] Filed: Apr. 22, 1992

[30] Foreign Application Priority Data

Apr. 23, 1991 [JP] Japan ..... 3-092322

[51] Int. Cl.[5] ..... H05H 3/00

[52] U.S. Cl. ..... 250/251

[58] Field of Search ..... 250/251

[56] References Cited

U.S. PATENT DOCUMENTS

| | | | |
|---|---|---|---|
| 3,657,542 | 4/1972 | Futch, Jr. et al. | 250/84 |
| 3,790,787 | 2/1974 | Geller | 250/251 |
| 4,783,595 | 11/1988 | Seidl | 250/423 R |
| 4,886,971 | 12/1989 | Matsumura et al. | 250/492.2 |
| 5,055,672 | 10/1991 | Nagai | 250/251 |

FOREIGN PATENT DOCUMENTS

| | | | |
|---|---|---|---|
| 1-38957 | 2/1989 | Japan | 250/251 |

OTHER PUBLICATIONS

Toshiba, Derwent Abstract No. 87-098509 (1987).
Nippon Telegraph, Patent Abstracts of Japan, vol. 13, No. 513 (E-847) (1989).
Nagai, Surface Science, vol. 10, No. 1, pp. 29-39 (1989).
Nagai et al., FAB-SIMS Study for Analysis of Insulators, pp. 448-450.
Nagai, Review of the Electrical Communications Laboratories, vol. 36, No. 6, pp. 587-592 (1988).
Shimokawa et al., Nuclear-Instruments and Methods in Physics Research B33, pp. 867-870 (1988).

*Primary Examiner*—Jack I. Berman
*Attorney, Agent, or Firm*—Wenderoth, Lind & Ponack

[57] ABSTRACT

An ion neutralizer which neutralizes electric charges on ions and produces a fast atom beam in an ultra-high vacuum comprising: an ion source disposed in a vacuum container; a hollow container disposed in the vacuum container, the hollow container being closed at both ends thereof except for an ion beam entrance hole provided in one end portion thereof and a fast atom beam exit hole provided in the other end portion thereof; a metal vapor generating source comprising a filament wound with a fine wire or ribbon of a metal selected from titanium, magnesium and aluminum, the filament being disposed in the hollow container in such a manner as to surround an axis connecting the ion beam entrance hole and the fast atom beam exit hole; a vacuum pump connected to the vacuum container; and a filament heating power supply disposed outside the vacuum container and the hollow container and connected to the filament.

5 Claims, 4 Drawing Sheets

ION NEUTRALIZER

BACKGROUND OF THE INVENTION

1. Field of the Invention

The present invention relates to an ion neutralizer. More particularly, the present invention relates to a neutralizer which neutralizes electric charge efficiently and produces a fast atom beam in an ultra-high vacuum.

2. Prior Art

An ion neutralizer which neutralizes electric charge on ions and produces a fast atom beam in an ultra-high vacuum is known.

FIG. 5 is a schematic view showing one example of conventional gas cell type ion neutralizers.

In the figure, reference numeral 1 denotes an ion source, 2 an ion beam, 3 a gas cell, 4 a gas nozzle, 5 a reaction gas, 6 a fast atom beam, 7 a vacuum container, 8 a vacuum pump, 9 an ion beam entrance hole 9, and 10 a fast atom beam exit hole.

The ion source 1, the gas cell 3 and the gas nozzle 4 are accommodated in the vacuum container 7.

The ion neutralizer comprising the above-described constituent elements operates as follows. After the vacuum container 7 has been sufficiently evacuated by the vacuum pump 8, an ion beam 2 is emitted from the ion source 1 toward the gas cell 3. A reaction gas 5, e.g., argon, has previously been injected into the gas cell 3 from the outside through the gas nozzle 4. The ion beam 2 entering the gas cell 3 through the ion beam entrance hole 9 collides with the molecules of the argon gas 5, thereby losing its electric charge, and thus being converted into a fast atom beam 6, which is released from the fast atom beam exit hole 10 of the gas cell 3.

However, in the above-described gas cell type ion neutralizer, the argon gas 5 injected into the gas cell 3 flows out from both the ion beam entrance hole 9 and the fast atom beam exit hole 10, causing a rise in the gas pressure in the vacuum container 7, and thus making it difficult to take out the fast atom beam 6 under a high vacuum. In particular, when a large amount of fast atom beam 6 is to be obtained, a large amount of argon gas 5 must be injected into the gas cell 3, so that it becomes more difficult to maintain a high vacuum in the vacuum container 7.

In the prior art, in order to maintain a high vacuum, it is necessary to employ for example, a vacuum pump 8 having an exceedingly large capacity, differential evacuation mechanism, etc. However, such means lead to an increase in the overall size of the apparatus, and an increase in the production and running costs of the apparatus. Thus, conventional ion neutralizers are disadvantageous from an economic point of view.

In the light of the above-described circumstances, it is an object of the present invention to provide an ion neutralizer designed to produce a fast atom beam in an ultra-high vacuum both easily and economically.

SUMMARY OF THE INVENTION

The object of the present invention is attained by an ion neutralizer comprising: an ion source disposed in a vacuum container; a hollow container disposed in the vacuum container, the hollow container being closed at both ends thereof except for an ion beam entrance hole provided in one end portion thereof and a fast atom beam exit hole provided in the other end portion thereof; a metal vapor generating source comprising a filament wound with a fine wire or ribbon of a metal selected from titanium, magnesium and aluminum, the filament being disposed in the hollow container in such a manner as to surround an axis connecting the ion beam entrance hole and the fast atom beam exit hole; a vacuum pump connected to the vacuum container; and a filament heating power supply disposed outside the vacuum container and the hollow container and connected to the filament.

In addition, the object of the present invention is attained by an ion neutralizer comprising: an ion source disposed in a vacuum container; a hollow container disposed in the vacuum container, the hollow container being closed at both ends thereof except for an ion beam entrance hole provided in one end portion thereof and a fast atom beam exit hole provided in the other end portion thereof; a metal vapor generating source comprising a filament wound with a fine wire or ribbon of a metal selected from titanium, magnesium and aluminum, the filament being disposed in the hollow container in such a manner as to surround an axis connecting the ion beam entrance hole and the fast atom beam exit hole; means for cooling the hollow container; a vacuum pump connected to the vacuum container; and a filament heating power supply disposed outside the vacuum container and the hollow container and connected to the filament.

In this invention, ion beam is injected into a metal vapor so that the ions contact lightly with the metal gas molecules, to thereby efficiently progress ion neutralization. Since the metal gas adheres to the inner wall of the hollow container and will not flow out into the vacuum container, it is possible to produce a fast atom beam in an ultra-high vacuum.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

Embodiments of the present invention will be described below in detail with reference to the accompanying drawings.

Figure 1:
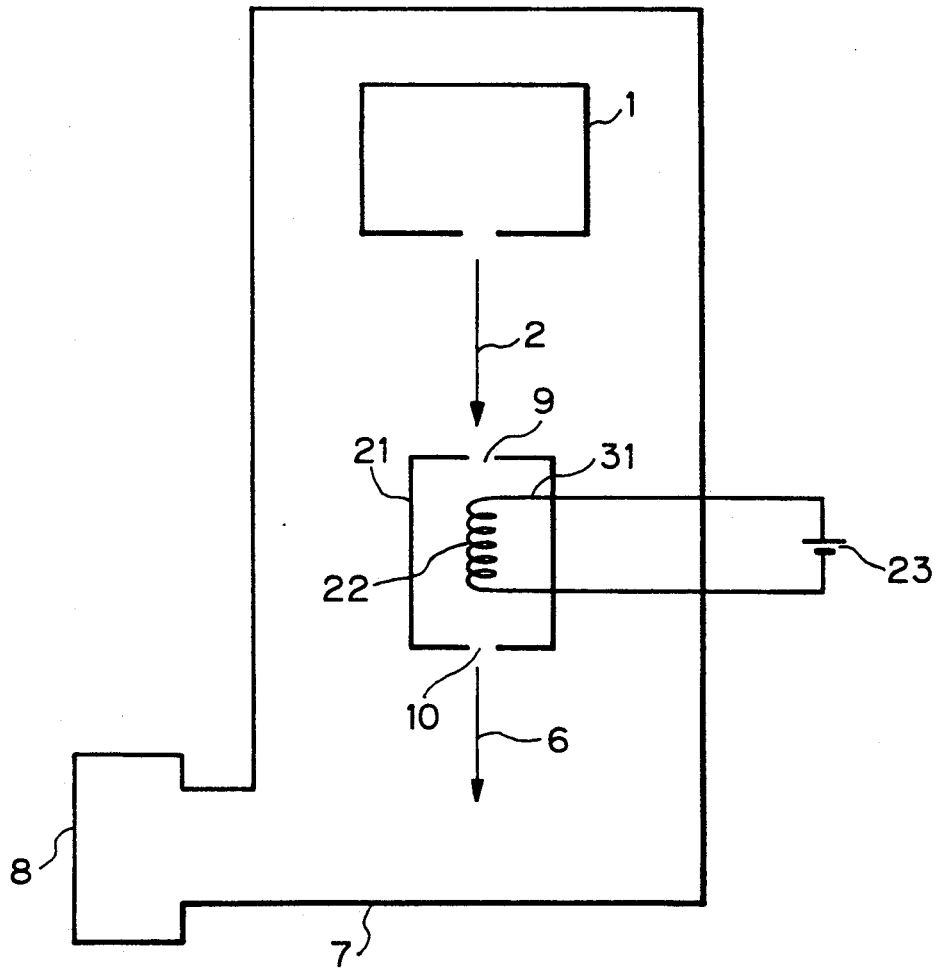
FIG. 1 shows schematically the arrangement of an ion neutralizer according to one embodiment of the present invention.

FIG. 1 shows schematically the arrangement of an ion neutralizer according to one embodiment of the present invention.

Figure 5:
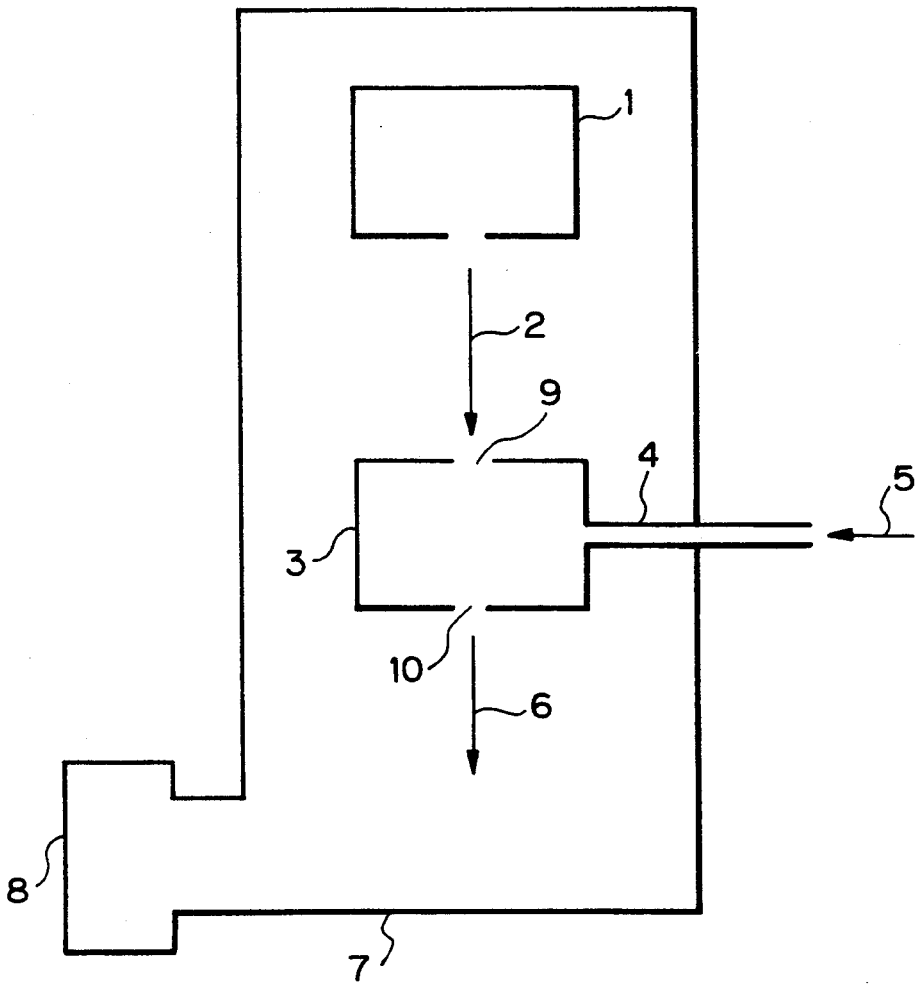
Fig. 5 PRIOR ART
FIG. 5 shows schematically a conventional gas cell type ion neutralizer.

It should be noted that in each of the following embodiments, constituent elements having the same structures as those in the above-described prior art shown in FIG. 5 are denoted by the same reference numerals.

In addition, in each of the embodiments, constituent elements, that is, a vacuum container 7, a vacuum pump 8 provided in connection to the vacuum container, and an ion source 1 disposed in the vacuum container to emit an ion beam, are disposed in the same way as in the prior art, and repetitions description thereof is omitted.

Referring to the drawing, the ion neutralizer of this embodiment comprises an ion source 1 and a cylindrical hollow container 21, which are disposed in a vacuum container 7, a metal vapor generating source 22 having a hot filament 31 and disposed in the hollow container 21, a vacuum pump 8 provided in connection to the vacuum container 7, and a heating power supply 23 disposed outside the vacuum container 7 and the hollow container 21 and connected to the filament 31. The ion source 1 is, for example, of a duo-plasmatron type or a liquid metal type and so on.

The power supply 23 heats the hot filament 31.

The hollow container 21 comprises a cylindrical hollow member both ends of which are closed except that an ion beam entrance hole 9 is provided in one end portion thereof, and a fast atom beam exit hole 10 in the other end portion thereof. The hollow container 21 is disposed such that the ion beam entrance hole 9 faces the ion source 1 so that the ion beam 2 emitted from the ion source 1 can enter the inside of the hollow container 21.

Figure 3:
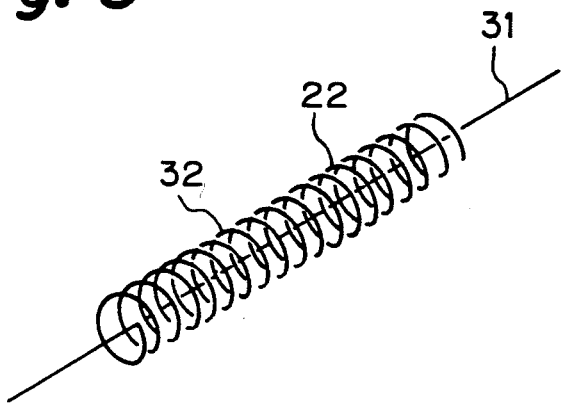
FIG. 3 shows the arrangement of a metal vapor generating source used in the ion neutralizer shown in FIG. 1.

The metal vapor generating source 22 comprises a spiral hot filament 31 that is installed inside the hollow container 21 in such a manner as to surround an axis connecting the ion beam entrance hole 9 and the fast atom beam exit hole 10, the hot filament 31 being wound with a fine wire 32 of titanium (see FIG. 3).

The metal vapor generating source 22 will be further explained with reference to FIGS. 2 and 3. The metal vapor generating source 22 comprises the hot filament 31 which is wound with the titanium fine wire 32. The hot filament 31 thus formed is then spirally wound. Although in this embodiment the titanium fine wire 32 is wound around the hot filament 31, another metal, e.g., magnesium or aluminum, may be selected in place of titanium. It is also possible to use a ribbon in place of a fine wire.

It should be noted that the above-described metal must meet the conditions that the vapor pressure is high at a high temperature, and when the metal vapor comes in contact with a wall at a low temperature, the vapor pressure becomes extremely low. As long as such conditions are satisfied, any metal can be employed in addition to the above-described ones. Alternatively, a non-metallic material, e.g., plastics, may also be employed.

The operation of the ion neutralizer arranged as described above will next be explained.

After the vacuum container 7 has been sufficiently evacuated by the vacuum pump 8 (see FIG. 1), the hot filament 31 of the metal vapor generating source 22 is heated by the heating power supply 23. By the heating, the fine wire 32 of titanium or magnesium or aluminum is evaporated in the form of a metal gas, so that the hollow container 21 is filled with this metal gas. Under these conditions, the ion beam 2 emitted from the ion source 1 (see FIG. 1) enters the hollow container 21 through the ion beam entrance hole 9. In consequence, the ions contact lightly with the metal gas molecules, thereby losing the electric charge, and thus being converted into fast atoms. That is, the electric charge of ions is transferred to the metal gas molecules through contact and, thus, ions are converted into fast atoms. Then, the fast atoms are released from the fast atom beam exit hole 10 in the form of a fast atom beam 6.

In the above-described operation process, titanium, magnesium or aluminum gas molecules generated from the metal vapor generating source 22 to which may or may not be imparted electric charge from the ions adhere on the inner walls of the hollow container 21 to return to solid form, so that there is no possibility of the gas molecules flowing out from the ion beam entrance hole 9 or the fast atom beam exit hole 10. Accordingly, the ion neutralizer of the present invention will not cause a lowering of vacuum level inside the vacuum container 7 as in the conventional gas cell type ion neutralizer, so that it is possible to produce a fast atom beam in an ultra-high vacuum. In addition, since the efficiency of contact between the ions and the metal gas molecules is relatively high, an ion neutralizer with high efficiency is obtained. Further, with this ion neutralizer, if the ion beam entering into the hollow container 21 has been focussed in advance, since no barrier is installed in the process of conversion from ions to fast atoms, the fast atom beam 6 is also output in focussed state. Thus, a focussed fast atom beam can be produced with ease.

Figure 4:
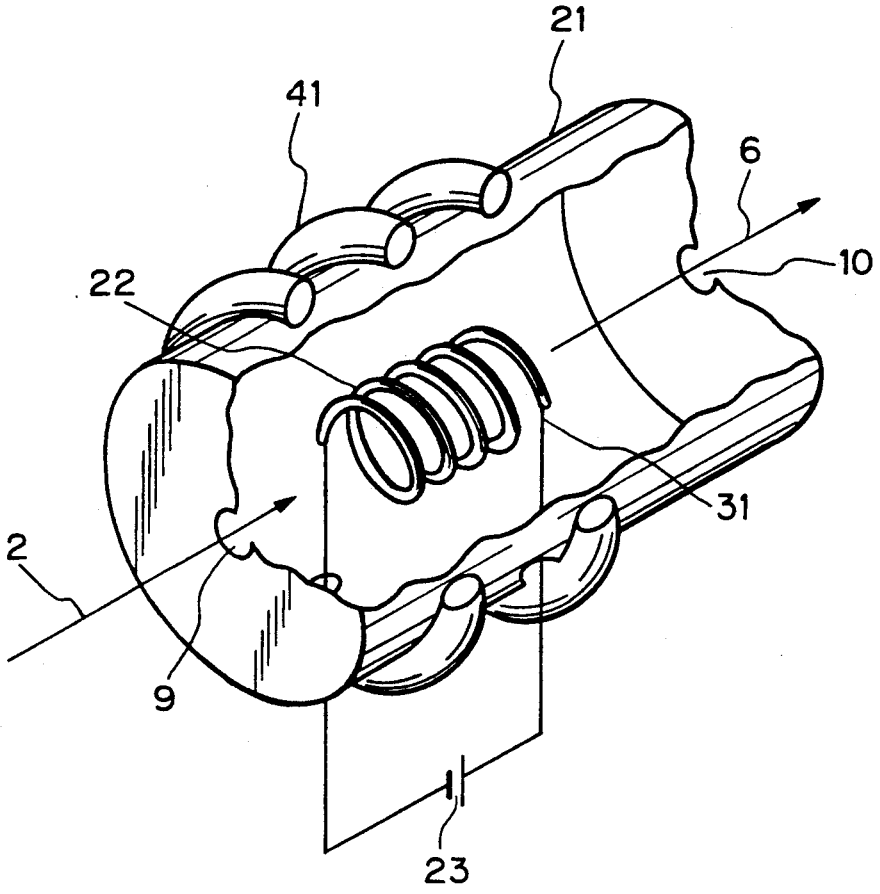
FIG. 4 shows schematically an essential portion of an ion neutralizer according to another embodiment of the present invention.

FIG. 4 shows an essential portion of an ion neutralizer according to another embodiment of the present invention.

Figure 2:
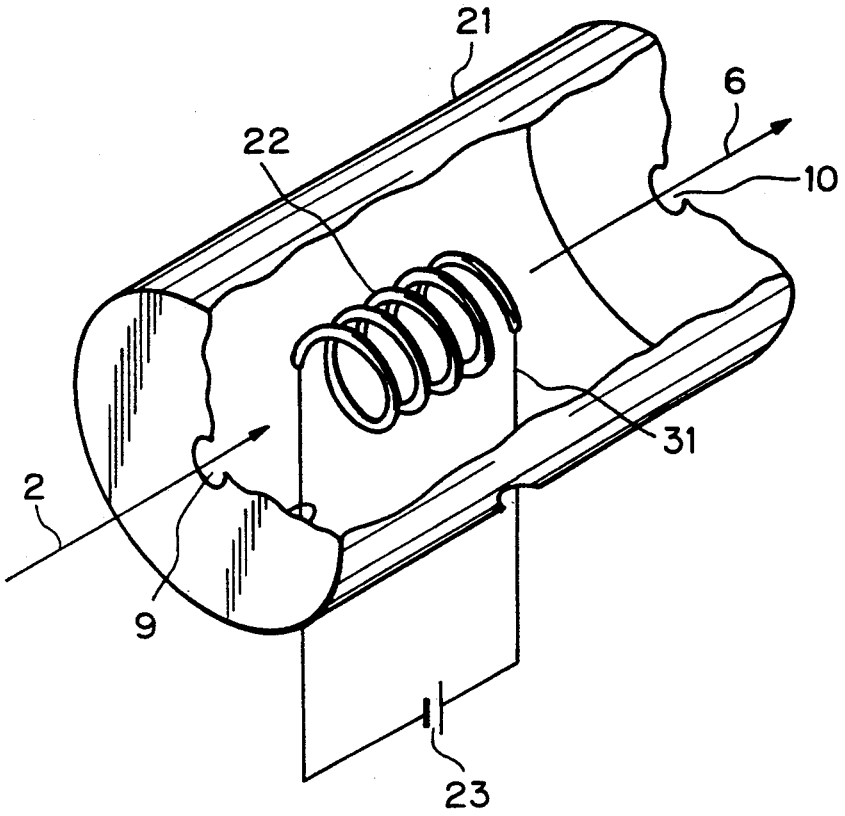
FIG. 2 shows schematically an essential portion of the ion neutralizer shown in FIG. 1.

In this embodiment, the ion neutralizer has the same structure as that of the embodiment shown in FIGS. 1 to 3 except for a water cooling coiled pipe (described after). Accordingly, in this embodiment only the structure and function of the water cooling coiled pipe will be explained.

The hollow container 21 is provided with a substantially spiral water cooling coiled pipe 41 that is fitted around the outer wall surface of the hollow container 21, as a means for cooling the container 21. The coiled pipe 41 is supplied with cooling water at a flow rate, for example, of 10 to 20 liters/min.

The ion neutralizer arranged in this way produces a fast atom beam 6 in the same way as that of the ion neutralizers described first. In this case, since the wall of the hollow container 21 is cooled through the water cooling coiled pipe 41, titanium, magnesium or aluminum gas molecules once attached to the wall are cooled rapidly. Accordingly, it is possible to greatly reduce the possibility that the gas molecules will reevaporate and diffuse into the vacuum container 7 through the ion beam entrance hole 9 or the fast atom beam exit hole 10. Thus, it is possible to obtain a fast atom beam 6 in a still higher vacuum level.

The fast atom beam obtained in each of the foregoing embodiments can be used for thin-film formation by sputter deposition, fine pattern fabrication by sputter etching, and material analysis by secondary ion mass spectrometry, in the same way as in the case of fast ion beams. In particular, since the fast atom beam is electrically neutral, it can be applied not only to metals and semiconductors but also to insulators such as plastics, ceramics, etc., to which the ion beam technique cannot effectively be applied. In this regard, the realization of an ion neutralizer which can produce a large amount of fast atom beam in a high vacuum is extremely useful for improving the efficiency of processing and analysis.

As has been described above, according to the ion neutralizer of the present invention, since any reaction gas such as argon is not employed to convert ions into an atom beam, there is no possibility of lowering the vacuum level due to undesirable gas blow into a vacuum container, so that it is possible to keep the inside of the vacuum container at a high vacuum at all times and to produce a fast atom beam with ease. If an ion beam in a focussed state is used, a focussed fast atom beam can be obtained with ease. In addition, since the ion neutralizer of the present invention does not require any arrangement for a reaction gas system including an evacuation system as is required in the prior art ion neutralizer, the structure of the apparatus can be simplified, and operating costs can be lowered.

What is claimed is:

1. An ion neutralizer comprising: an ion source disposed in a vacuum container; a hollow container disposed in said vacuum container, said hollow container being closed at both ends thereof except for an ion beam entrance hole provided in one end portion thereof and a fast atom beam exit hole provided in the other end portion thereof; a metal vapor generating source comprising a filament wound with a fine wire or ribbon of a metal selected from titanium, magnesium and aluminum, said filament being disposed in said hollow container in such a manner as to surround an axis connecting said ion beam entrance hole and said fast atom beam exit hole; a vacuum pump connected to said vacuum container; and a filament heating power supply disposed outside said vacuum container and said hollow container and connected to said filament.

2. An ion neutralizer according to claim 1, wherein said hollow container is a cylindrical hollow member.

3. An ion neutralizer comprising: an ion source disposed in a vacuum container; a hollow container disposed in said vacuum container, said hollow container being closed at both ends thereof except for an ion beam entrance hole provided in one end portion thereof and a fast atom beam exit hole provided in the other end portion thereof; a metal vapor generating source comprising a filament wound with a fine wire or ribbon of a metal selected from titanium, magnesium and aluminum, said filament being disposed in said hollow container in such a manner as to surround an axis connecting said ion beam entrance hole and said fast atom beam exit hole; means for cooling said hollow container; a vacuum pump connected to said vacuum container; and a filament heating power supply disposed outside said vacuum container and said hollow container and connected to said filament.

4. An ion neutralizer according to claim 3, wherein said cooling means comprises a water cooling coiled pipe fitted around the outer wall surface of said hollow container.

5. An ion neutralizer according to claim 3, wherein said hollow container is a cylindrical hollow member.

* * * * *